United States Patent [19]

Manning

[11] 4,214,697

[45] Jul. 29, 1980

[54] LIQUID GABLE TOP CARTON WITH INTEGRAL CARRYING HANDLE

[75] Inventor: James F. Manning, Strongsville, Ohio

[73] Assignee: Champion International Corporation, Stamford, Conn.

[21] Appl. No.: 955,809

[22] Filed: Oct. 27, 1978

[51] Int. Cl.[2] ..... B65D 5/74; B65D 5/46

[52] U.S. Cl. ..... 229/52 B; 229/17 G

[58] Field of Search ..... 229/52 B, 17 G

[56] References Cited

U.S. PATENT DOCUMENTS

| | | | |
|---|---|---|---|
| 2,379,665 | 7/1945 | Stone | 229/52 B X |
| 2,901,159 | 8/1959 | Talbot, Jr. | 229/52 B X |
| 2,933,232 | 4/1960 | Bugnone | 229/52 B X |
| 3,096,012 | 7/1963 | Bryant et al. | 229/52 B |
| 3,175,750 | 3/1965 | Bump | 229/52 B X |
| 3,217,966 | 11/1965 | Kelly | 229/52 B X |
| 3,227,353 | 1/1966 | Bump | 229/52 B X |
| 3,339,820 | 9/1967 | Krzyzanowski | 229/17 G |
| 3,581,974 | 6/1971 | Freeman | 229/52 B X |
| 3,591,070 | 7/1971 | Vrana | 229/52 B X |
| 3,924,797 | 12/1975 | Furbeck | 229/17 G |

*Primary Examiner*—Davis T. Moorhead

*Attorney, Agent, or Firm*—Evelyn M. Sommer

[57] ABSTRACT

A paperboard carton having a gable top for forming a liquid pouring spout is provided with an integral handle on the gable top to aid in pouring the liquid contents of the carton and in carrying the carton.

2 Claims, 7 Drawing Figures

LIQUID GABLE TOP CARTON WITH INTEGRAL CARRYING HANDLE

BACKGROUND OF THE INVENTION

1. Field of the Invention

This invention relates to a gable top carton, and more particularly, a gable top carton of the type used to contain milk and similar liquids provided with an integral handle for facilitating the carrying of the carton and pouring of its contents through the gable top.

2. Description of the Prior Art

For many years, cartons for milk and similar liquids were formed in part by setting up a preformed blank with the bottom of the carton closed and dipping the carton in molten paraffin to seal it. Thereafter, the carton was filled and its top closed.

The wax or paraffin coated carton has been almost entirely supplanted by a heat sealable thermoplastic coated carton. The manufacture of the latter carton is different from the wax coated carton in several material respects. Instead of applying the sealing coating after the carton is almost completely formed, the coating of thermoplastic is applied to a paperboard web by extruding it as a thin film onto the paperboard web as one of the earliest steps in the formation of the carton and before any of the other steps are performed such as cutting a blank from the web, scoring and folding it, and the like. After coating, the web is cut into blanks, which are scored and folded into cartons and its bottom structure is sealed by applying heat to the overlapping flaps or panels by which the bottom structure is formed, the heat bringing the thermoplastic between adjacent surfaces. Similarly where the carton has a gable top, or one which when unfolded forms an integral pouring spout, it is folded and sealed along a ridge line by heating the thermoplastic coating.

The carton details, per se, and manner of assembly thereof are fully disclosed in U.S. Pat. No. 3,120,335. As shown in more detail in this patent, the carton bottom structure is formed by folding panels transversely across the bottom of the carton, the panels being folded on score lines. The bottom structure is completed by applying heat and pressure to the panels which are folded upon one another. The thermoplastic which has been applied to the paperboard fuses during the application of heat and pressure to form a sealed bottom structure.

After the carton bottom structure has been formed, the carton is filled with milk or other liquid and then the top seal is formed by folding the gable top panels on score lines and fusing adjacent surfaces.

Such cartons are somewhat inconvenient to handle, especially in the larger gallon sizes which have become more desirable to the consumer because of decreased cost in buying milk in quantity. Not only are such filled cartons heavy to carry, but upon opening of the gable top to pour the contents, the large bulk of the side of the carton precludes the side of the carton from being readily grasped to tilt the carton. Accordingly, users have resorted to pivotable or tiltable racks which support the carton while pouring the contents, leading to increased cost and bother in their use.

This problem is readily solved by the carton of the present invention. The carton of the invention is provided with an integral carrying handle which can be readily grasped to hold the carton while pouring its contents through the gable top.

While the provision of a handle on the carton may appear to be a simple solution to the problem, no one in the art has been successful in economically manufacturing such a carton with an integral carrying handle heretofore. The carton blanks which are cut and scored from the coated paperboard web must be laid out and positioned on the web to attain maximum utilization of the paperboard, leaving as little scrap as possible. The addition of handle components to the blank above the top seal must be accomplished in such a manner so the entire standard carton blank layout on the paperboard web accommodates the handles within the parameters of the web while retaining the approximate number of blanks obtained from the same area of paperboard web heretofore. To complicate this problem, the blank width and height must also be maintained to strict specifications precluding redesigning of the blank by, for example, increasing its width and decreasing its height to yield the same cubic capacity. Finally, the web width must be such as to fit existing web handling equipment without substantial modification.

Additionally, the location and joinder of the handle components on the blank must not interfere with the breaking of the seal so that the contents can be poured from the container.

SUMMARY OF THE INVENTION

Accordingly, this invention provides a gable top, liquid-containing, carton having an integral carrying handle which can be economically mass produced using standard carton forming machinery and methods of production. The handle is used to carry the container and to assist in pouring the contents of the carton.

The manufacturing problems attendant to producing a blank with an integral carrying handle have been overcome without substantial modification of existing equipment or the standard web width from which the blanks are manufactured by modifying the web layout and designing the carton blanks with handle components on alternate gable top panels of the blank so as to enable handle components formed on adjacent blanks on the web, in what would normally be scrap areas on the web, to interleave. When the blank is folded into the carton, the handle components on the gable top can be abutted and sealed to form an integral carrying handle.

A continuous thermoplastic coat along the top edge of the blank is extruded to form the top seal and to preclude moisture penetration of the handle. This enables a suitable seal to be formed along the entire top edge of the blank, as required. The sealing jaws can be relieved adjacent the front portions of the handle to preclude the joinder of approximately one-half of the handle components, while only sealing the handle components along opposing surfaces remote from the pouring spout end of the gable top. The gable top seal can thus be readily broken and the top closed, without interference from the handle components.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
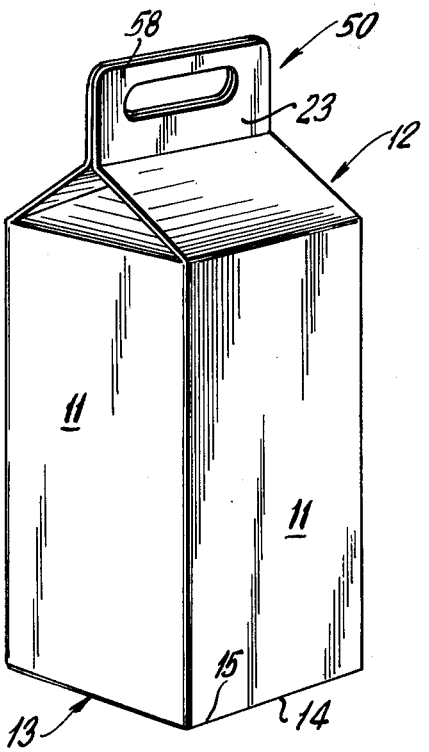
FIG. 1 is a front perspective view of the assembled carton of the present invention.
Figure 5:
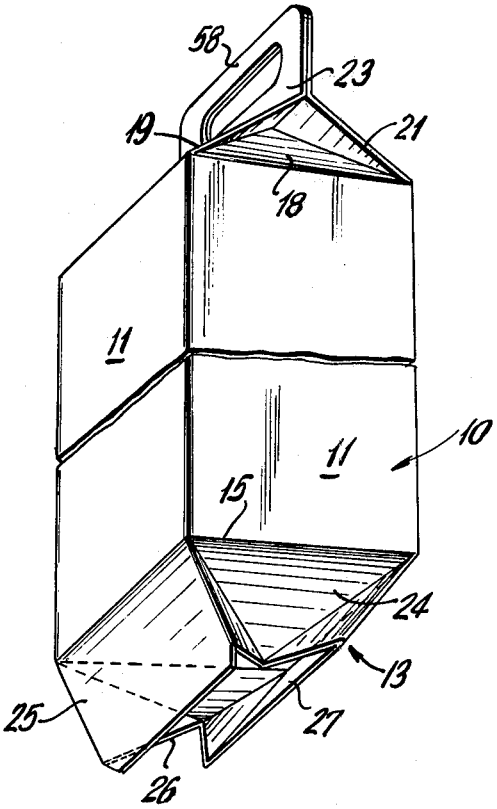
FIG. 5 is a back perspective view of the carton of FIG. 1, also illustrating the manner of folding the bottom of the carton from the blank of FIG. 3.
Figure 6:
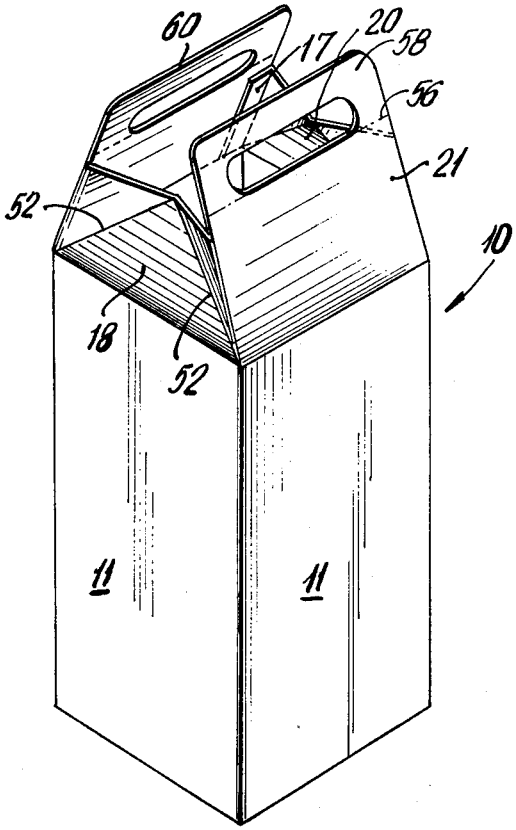
FIG. 6 is a partial front perspective view of the carton of FIG. 1 illustrating the manner of folding the gable top of the carton from the blank of FIG. 3.
Figure 7:
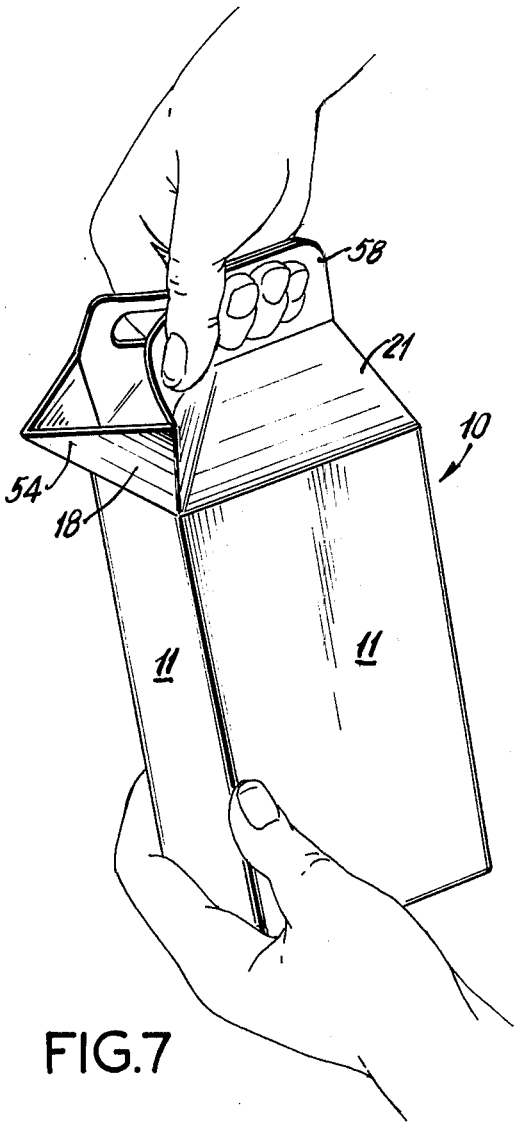
FIG. 7 is a front perspective view illustrating the manner of using the carton of FIG. 1.

Referring now to the drawings in detail, wherein like numerals indicate like elements throughout the several views, a carton formed in accordance with the present invention is illustrated in FIG. 1. The carton 10 has vertical walls 11, a top structure 12 including an integral carrying handle 50, and a bottom structure 13. The top structure 12 is folded in a conventional manner, as shown in FIG. 6 and as illustrated in U.S. Pat. No. 3,116,002 and is adapted to seal the liquid contents within the carton and further is adapted to be opened in such a way as to form a pouring spout 54 for the liquid contents. The bottom structure likewise is folded in a conventional manner as shown in FIG. 5 and as described in U.S. Pat. No. 3,120,335.

The bottom structure is formed by folding the bottom closure panels on a major horizontal score line 14 (FIG. 3) to form the bottom corner structure 15. As indicated above, the paperboard 24' with which the carton is formed is first coated on both sides with a suitable heat-sealable thermoplastic material 30. The temperature of the coating is raised to the extent necessary to fuse the thermoplastic material and form a bond between adjacent panel members, and thereafter the bottom closure forming the panels are folded with respect to each other with the plastic coated surfaces being brought into contact under pressure thereby effecting the sealing of the bottom structure.

Figure 3:
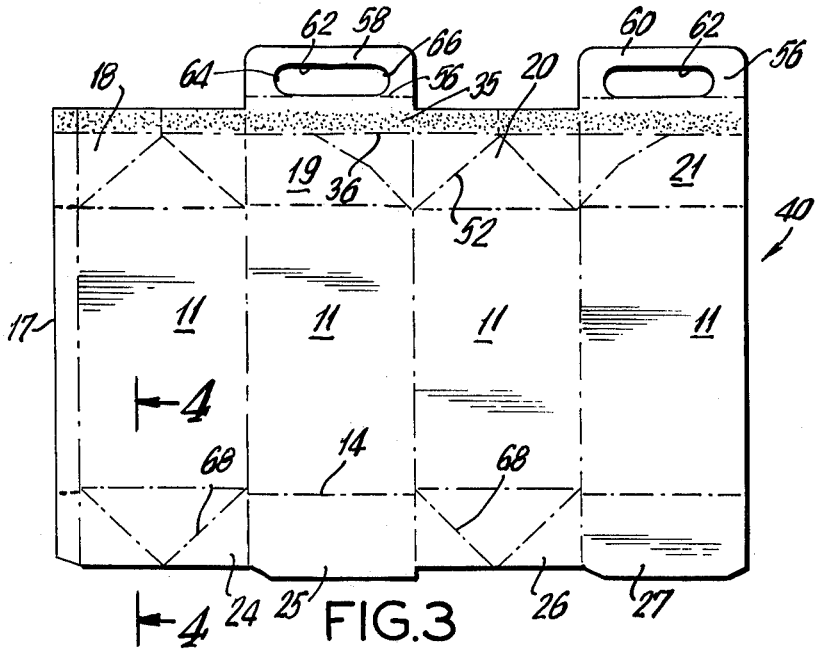
FIG. 3 is a top plan view of one of the blanks used to form the carton of FIG. 1.
Figure 4:
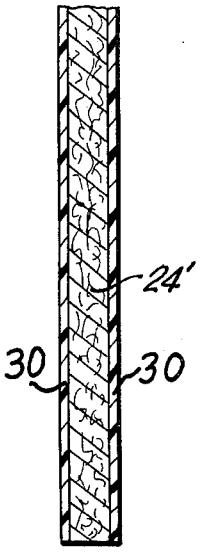
FIG. 4 is a cross-sectional view taken substantially along the plane indicated by line 4—4 of FIG. 3.

Referring to FIG. 3, a blank 40 of the type from which a carton 10 is formed is illustrated. The blank includes four vertical walls 11 and a side seam flap 17. At the upper end of the blank, two pairs of opposed flexing panels 18, 20 and handle panels 19, 21, alternatively are connected to the walls 11 along a top major horizontal score line 22. These panels will, after the carton is filled, be folded together as shown in FIG. 6 along score lines indicated at 52 and sealed along a ridge 23 (FIG. 1) to form the top structure of the carton, which includes a seal and after opening, a reclosable pouring spout 54, as shown in the above cited patents. Connected to alternate, handle panels 19 and 21 along a horizontal score line 56 are handle components 58 and 60 of carrying handle 50. Each component 58, 60 includes an ovoid-shaped opening 62 having rounded opposed edge portions 64, 66. The components 58, 60 extend above the sealed ridge 23.

At the bottom of the carton, four panels 24, 25, 26 and 27 are joined together and are hinged to the vertical walls 11 along the bottom major horizontal score line 14. The bottom closure forming panels are, in forming the carton, folded with respect to one another in overlapping relation and heat sealed to form a leak-tight bottom structure, along score line 14 and score lines 68, as illustrated in FIG. 5.

In the sealing of the top structure 12, a narrow strip 35 of the thermoplastic film applied to the marginal edge portions of the flexing and handle panels 18, 19, 20 and 21, are brought together under heat and pressure to form the ridge seal 23. While all of the handle components 56 and 58 are thermoplastically coated to preclude moisture penetration of the paperboard, the sealing jaws applying heat and pressure along ridge 23 can be relieved to seal only approximately the rear half of adjacent handle components 58, 60, leaving the portion adjacent spout 54 unsealed. The sealed portions of the handle components are thus formed by applying spot heat and pressure on the trailing half of the handle components 58, 60. Therefore, the ridge seal 23 will still be left intact when the carton is sealed by virtue of the abutting surfaces in strip 35, but half of the handle adjacent spout 54 will remain unsealed. When the seal along ridge 23 is broken to form spout 54, the handle components will not interfere with the opening or closing of the spout and the liquid contents can be readily poured.

Figure 2:
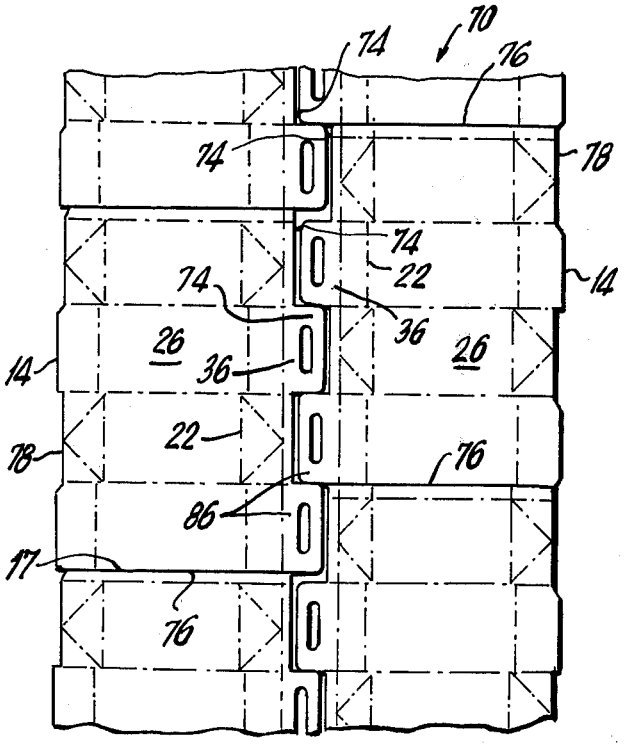
FIG. 2 is a top plan view of a web from which blanks for forming the carton of FIG. 1 are cut.

The manner in which the blank 40 is formed is illustrated in part in FIG. 2 which is a plan view of a fragment of a paperboard web 70 which is coated with the plastic. Thereafter, the carton blanks will be cut, scored, formed into cartons and filled.

The lines shown on the web 70 illustrate where the longitudinal top forming cut lines 74, the transverse cut lines 76, major horizontal score lines 14 for the bottom structure, and the bottom forming cut lines 78 occur. As shown, the pattern of each blank 40 is such that the handle components of transversely adjacent blanks are interleaved and nested with each other along their top cut lines.

What is claimed as new is:

1. A reclosable gabled top container having a pour spout and integral handles comprising:

a generally tubular side wall formed from four hingedly connected side panels;

a bottom closure portion hingedly connected to the bottom edges of said tubular side wall; and a gabled top closure formed from first and second opposed flexing panels, and first and second opposed handle panels, said opposed flexing panels being hingedly connected to the top edge of two opposed side panels of said tubular side wall, said flexing panels being formed from three hingedly connected generally triangular sections with an apex of each said triangular section being disposed at a common point, and with said opposed handle panels being hingedly connected to the top edge of the remaining two opposed side panels, with said flexing panels being flexed inwardly such that said handle panels are inclined inwardly whereby the top edges thereof meet along a line thereby forming a gabled configuration, there being a glue strip provided along said line of meeting between said handle panels to seal said carton, and with each said handle panel including a pair of handle members respectively hingedly connected along the top edge thereof, said handle members being in abutting relationship and extending vertically upwardly from said gabled top configuration, said handle members being partially adhesively connected therebetween, the adhesive connection between said handle members extending from the side edges of said handle members adjacent said first flexing panel to a point intermediate the length of said handle members, whereby said gabled top may be readily opened to form a pour spout by first separating the top edges of said handle panels along said glue strip, from the side edge of said handle panels adjacent said second flexing panel to a point intermediate the length thereof and thereafter outwardly flexing said second flexing panel to form the pour spout, with the portions of said handle members, adjacent said second flexing panel, which are not adhesively connected, separating to facilitate the opening of said gabled top, and wherein the adhesively connected portions of said handle members, adjacent said first flexing panel, remain sealed and in the upright vertical position to aid in pouring the contents of said carton.

2. A gabled top container as recited in claim 1 wherein each of said handle members includes an oval shaped opening having arcuate corners.

* * * * *